US006945271B2

(12) United States Patent
Huang

(10) Patent No.: US 6,945,271 B2
(45) Date of Patent: Sep. 20, 2005

(54) GARDENING HOSE REEL

(75) Inventor: Huang-Fu Huang, Changhua Hsien (TW)

(73) Assignee: Chuan Yi Plastic Co., Ltd., Taichung (TW)

( * ) Notice: Subject to any disclaimer, the term of this patent is extended or adjusted under 35 U.S.C. 154(b) by 0 days.

(21) Appl. No.: 10/776,046

(22) Filed: Feb. 12, 2004

(65) Prior Publication Data

US 2005/0178440 A1 Aug. 18, 2005

(51) Int. Cl.[7] ..... B65H 75/34
(52) U.S. Cl. ..... 137/360; 137/355.26; 137/580
(58) Field of Search ..... 137/360, 355.26, 137/580

(56) References Cited

U.S. PATENT DOCUMENTS 1,752,048 A * 3/1930 Woodford ..... 137/355.18
2,170,281 A * 8/1939 Snow ..... 604/259
4,537,215 A * 8/1985 Roman ..... 137/355.26
4,713,497 A * 12/1987 Smith ..... 191/12.2 R
5,392,808 A * 2/1995 Pierce ..... 137/355.23
5,560,391 A * 10/1996 Bantaculo ..... 137/355.23
6,588,444 B2 * 7/2003 Paplow et al. ..... 137/15.01

* cited by examiner

*Primary Examiner*—A. Michael Chambers
(74) *Attorney, Agent, or Firm*—Egbert Law Offices

(57) ABSTRACT

A gardening hose reel includes a main frame, having a reel notch, which is provided for roll-up of the gardening hose. The water inlet terminal of the gardening hose is pulled outward from the central outlet of the reel notch and affixed to the faucets and the water outlet terminal goes through the through notch on the other end of the main frame. The features of the present invention include a rotary connector, which is installed on the water outlet terminal of the gardening hose at the reel notch outlet segment; when the water outlet terminal of the gardening hose is pulled outward, the water inlet terminal turns with the rotary connector to inhibit linkage with the water inlet terminal of the gardening hose so as to prevent the gardening hose from spiral and twisted shape.

4 Claims, 7 Drawing Sheets

GARDENING HOSE REEL

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a gardening hose reel, and more particularly to a gardening hose reel whose water inlet terminal is designed with a rotary connector for innovative design.

BACKGROUND OF THE INVENTION

Gardening hose reel is an instrument that is designed for convenient storage of a gardening hose. The traditional gardening hose reel comprises a notch for roll-up of a gardening hose. The water inlet terminal of the gardening hose can be pulled outward from the center of said notch, the water outlet terminal can be pulled outward from the seam of the other end of the reel. Problems arise from the traditional design concern the following.

Given the different pulling directions of the water inlet and outlet terminals, when the water outlet terminal is pulled outward, the water inlet terminal rotates radially as a direct result. If the water inlet terminal is affixed to the faucet, the gardening then appears in spiral and twisted shape. Therefore, the use of a traditional gardening reel requires pulling the water outlet terminal to the desired length, then affix the water inlet terminal to the faucet. Otherwise, spiral and twisted shapes would occur when the gardening hose is pulled. It not only results in obstruction of water flow but also leads to damage to the gardening hose.

Therefore, in regards to the above-mentioned problems, an innovative design to improve the spiral and twisted shape of the gardening hose needs to be concerned.

BRIEF SUMMARY OF THE INVENTION

The benefits of the prevent invention are as follows:

1. It provides an innovative rotary connector 40 design of the reel notch 11 outlet 12 at the water inlet terminal 21 of the gardening hose 20.
2. When the water outlet terminal 22 of the gardening hose 20 is pulled outward, the water inlet terminal 21 turns with the rotary connector 40 to inhibit linkage with the water inlet terminal 21 of the gardening hose 20 so as to prevent the gardening hose 20 from spiral and twisted shape.

The improved functions of the prevent invention are as follows:

The main frame 10 can be placed on a horizontal rotary frame 50 can rotate along pulling direction of the water outlet terminal 22 of the gardening hose 20 for smooth usage.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
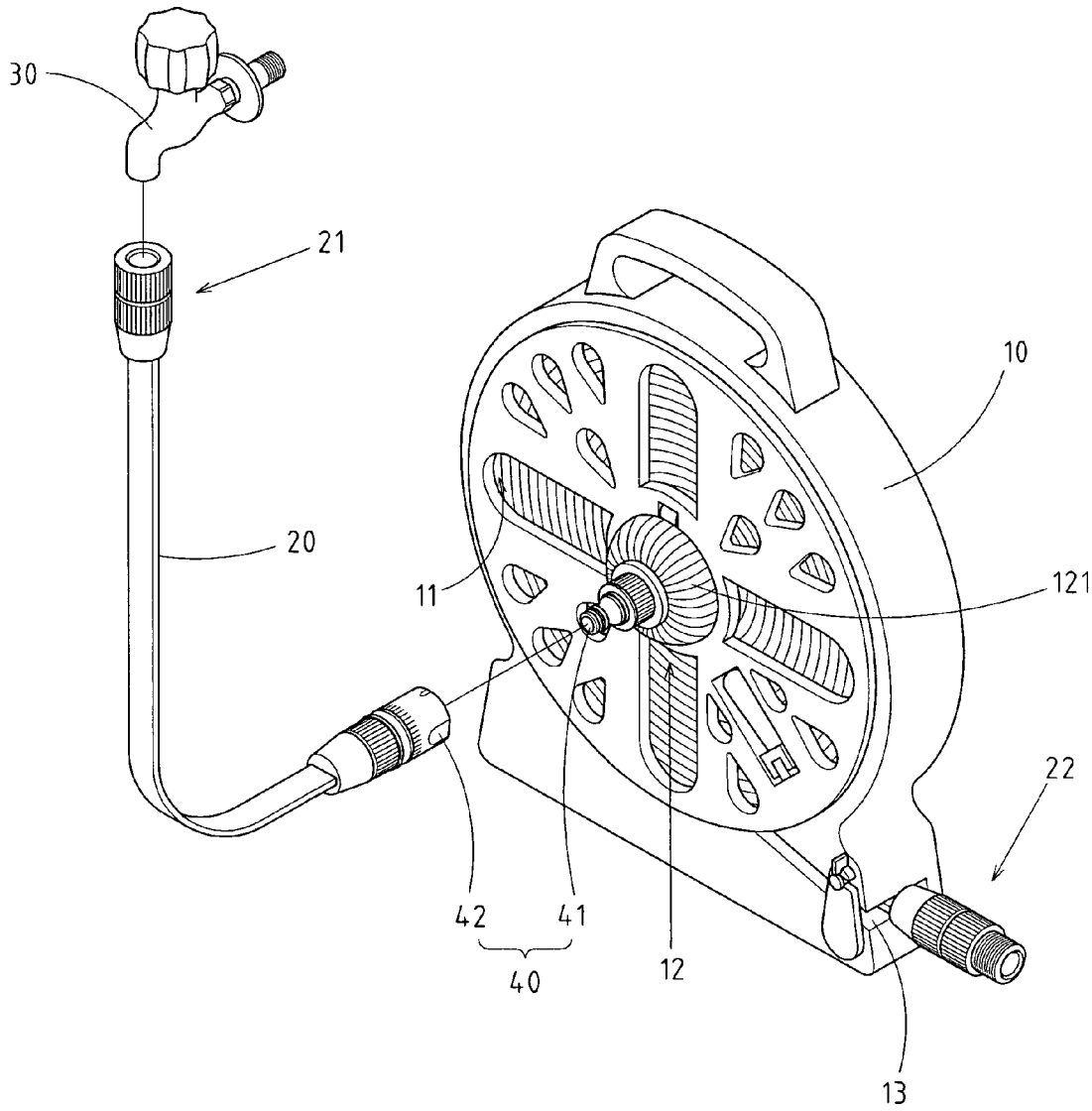
FIG. 1 shows a perspective view of the preferred embodiment of the present invention.
Figure 2:
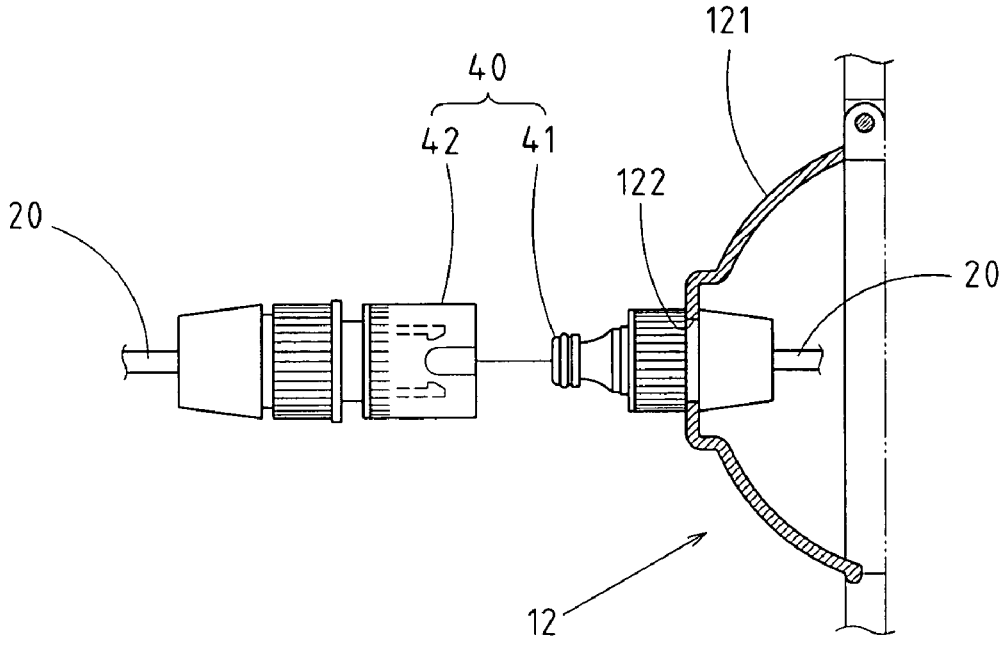
FIG. 2 shows an exploded perspective view of the rotary connector of the present invention.
Figure 3:
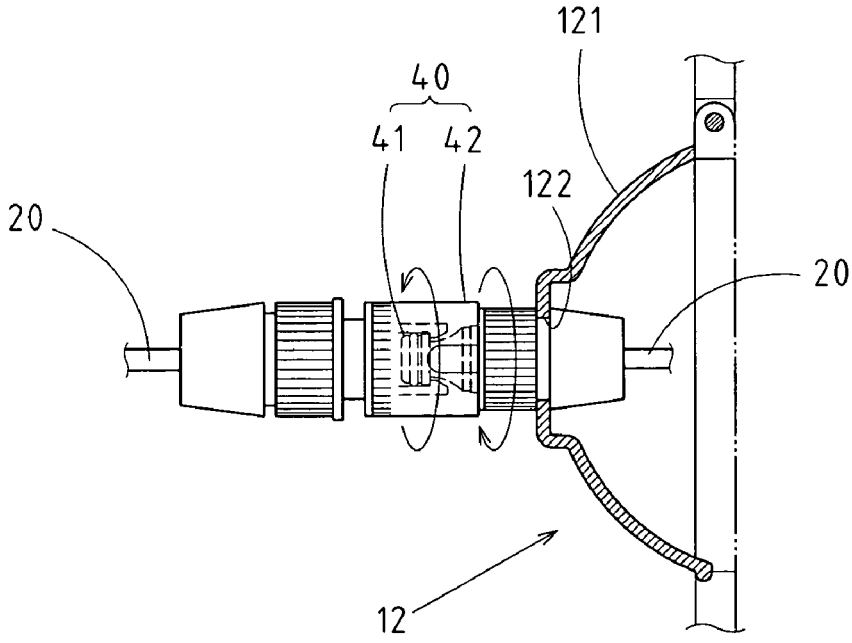
FIG. 3 shows a schematic view of a drawing of the assembled rotary connector of the present invention.

As shown in FIG. 1, a gardening hose reel embodied in the present invention comprises a main frame 10, which comprises a reel notch 11, provided for a gardening hose 20 to be contained within; the water inlet terminal 21 of the gardening hose 20 is pulled outward from the central outlet 12 of the reel notch 11, then connected to the faucet 30; the other end of the main frame 10 contains a through notch 13 provided for the water outlet terminal 22 of the gardening hose 20 to go through.

Figure 4:
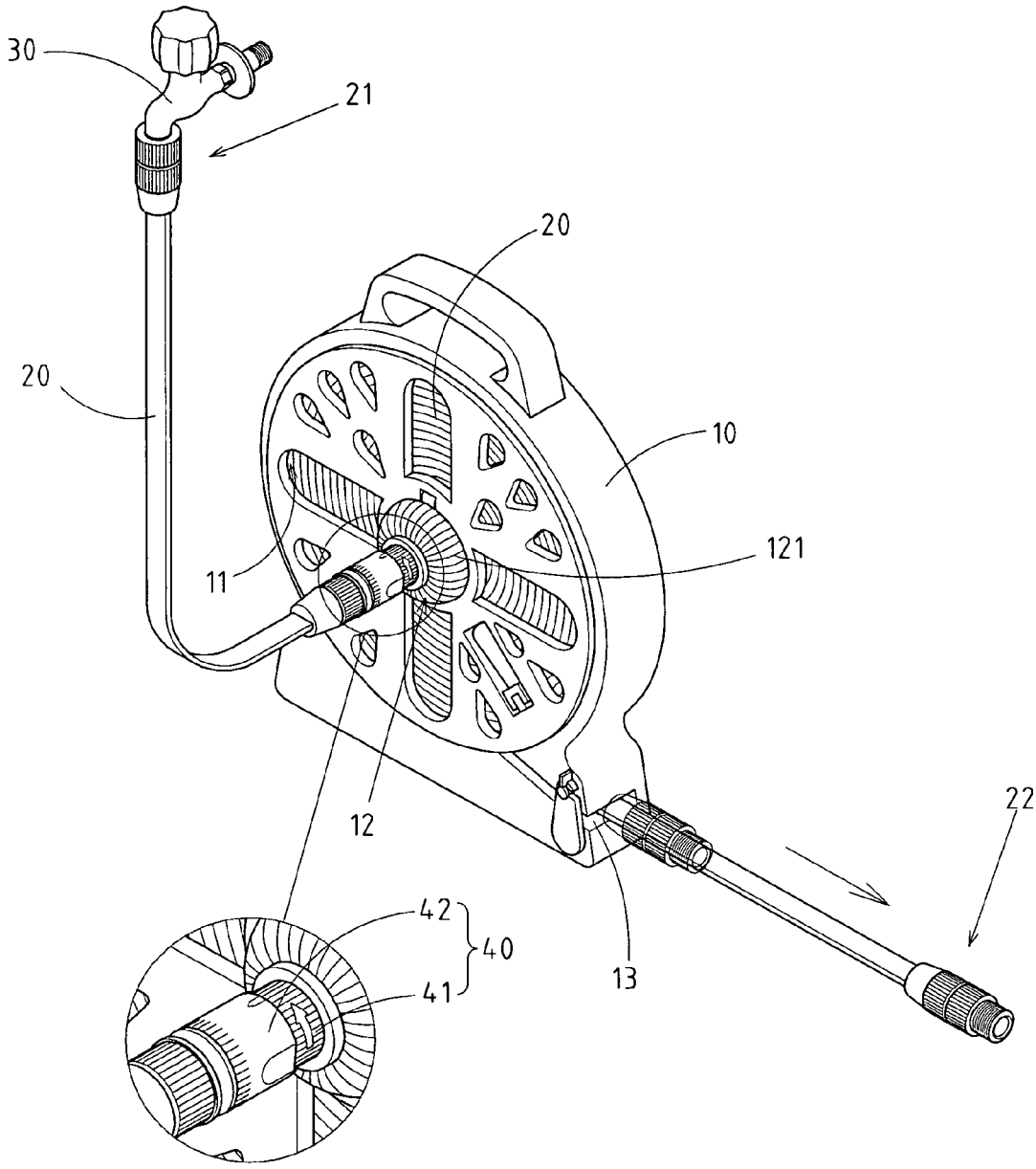
FIG. 4 shows a sectional view of the present invention in operation.

The features of the present invention includes a water inlet terminal 21 of the gardening hose 20 contains a rotary connector 40 at the outlet 12 of the reel notch 11. When the water outlet terminal 22 is pulled outward (as shown in FIG. 4), the water inlet terminal of the gardening hose 20 turns with the rotary connector 40 to inhibit linkage with the water inlet terminal 21 of the gardening hose 20 so as to prevent the gardening hose 20 from spiral and twisted shape.

Whereas the rotary connector 40 is comprised of the primary connector 41 and the secondary connector 42. The connectors are built upon the existing connector set and can be turned radially in separate directions. The central outlet 12 of the reel notch 11 contain a casing 121 which comprises a pivot hole 122 to limit the primary connector 41; the internal of the secondary connector 42 is connected to the primary connector 41, and the external is connected to the water inlet terminal 21 of the gardening hose 20.

Figure 5:
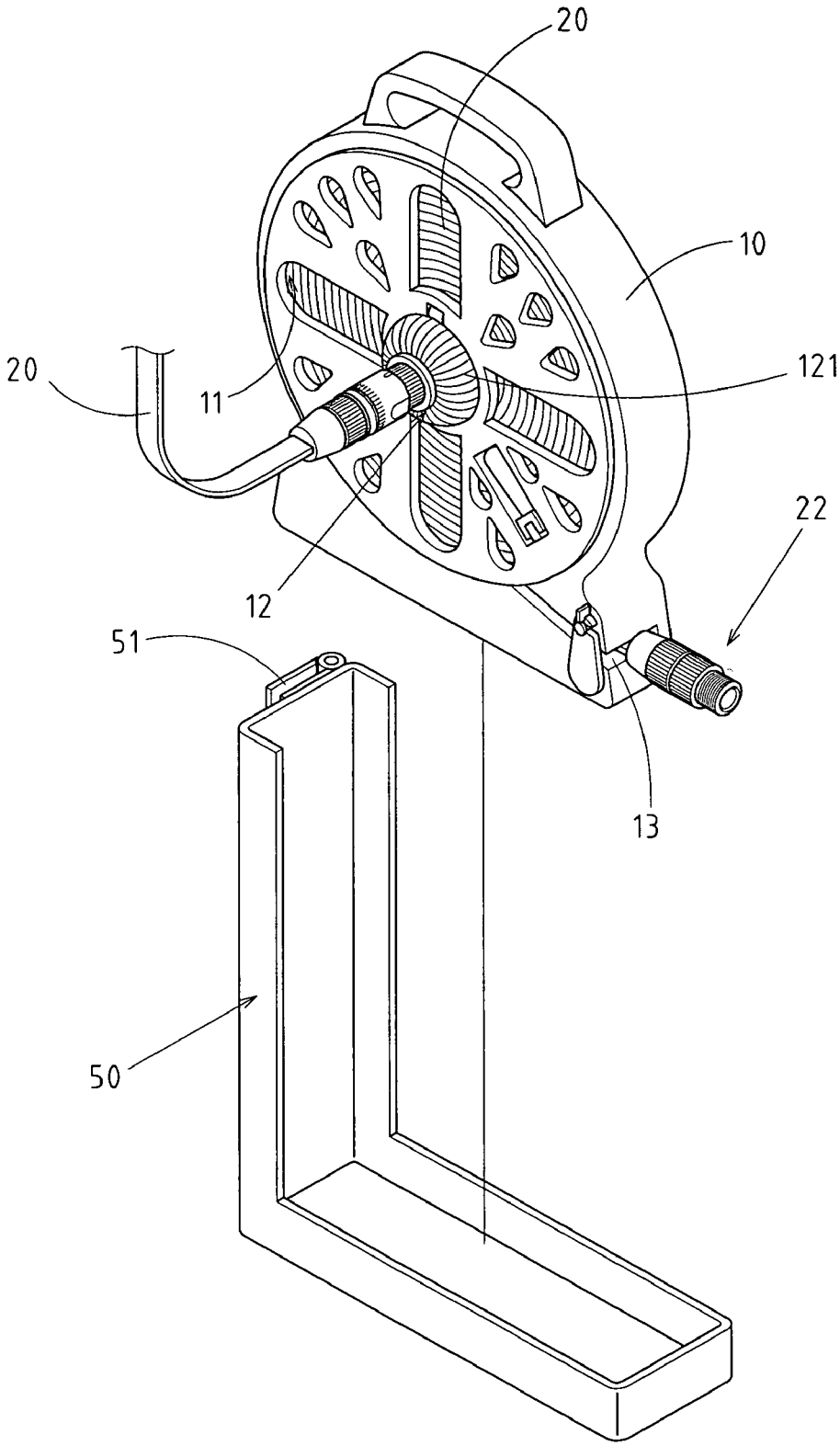
FIG. 5 shows an exploded perspective view of the placement of the main frame on the reel frame.
Figure 6:
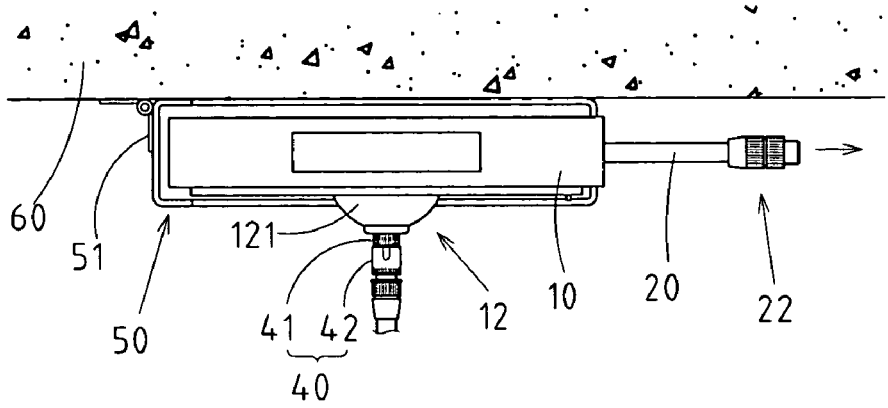
FIGS. 6–7 show sectional views of the structure presented in FIG. 5 in operation.
Figure 7:
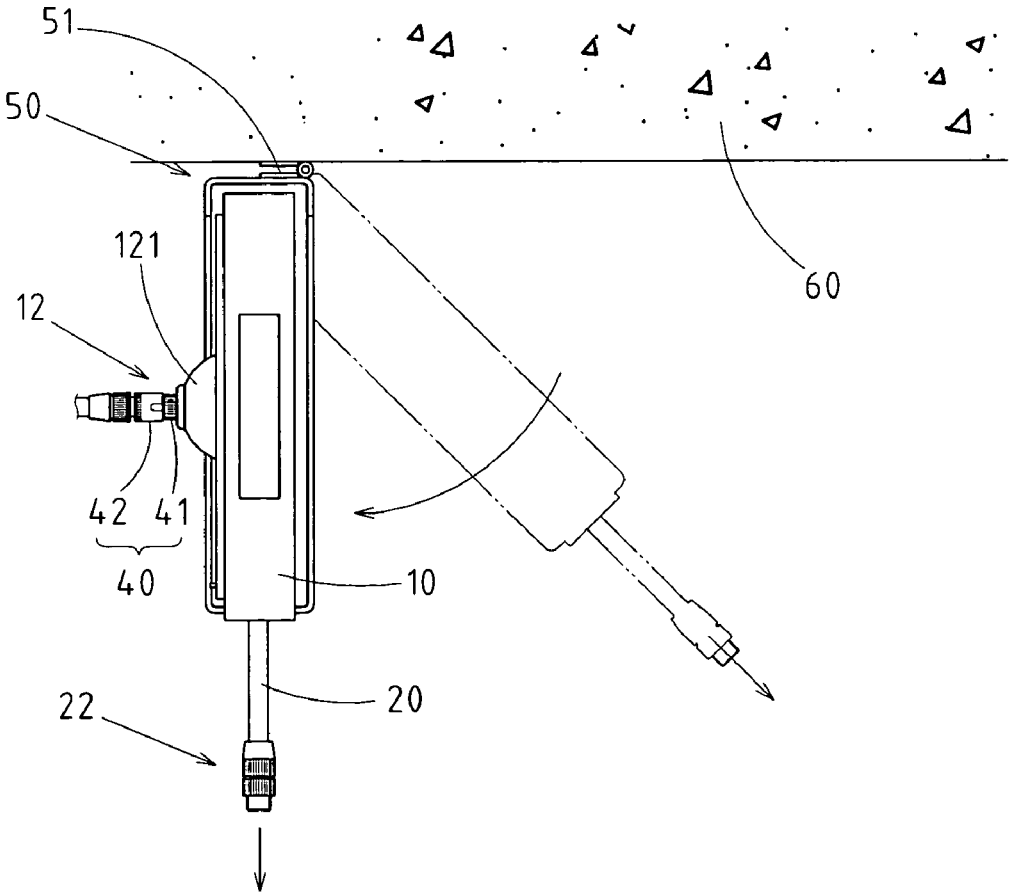

As shown in FIG. 5, the main frame 10 can be placed on a horizontal rotary frame 50, which comprises of a rear button to be placed on wall 60. As shown in FIGS. 6–7, the main frame 10 can rotate along pulling direction of the water outlet terminal 22 of the gardening hose 20 for smooth usage.

Figure 8:
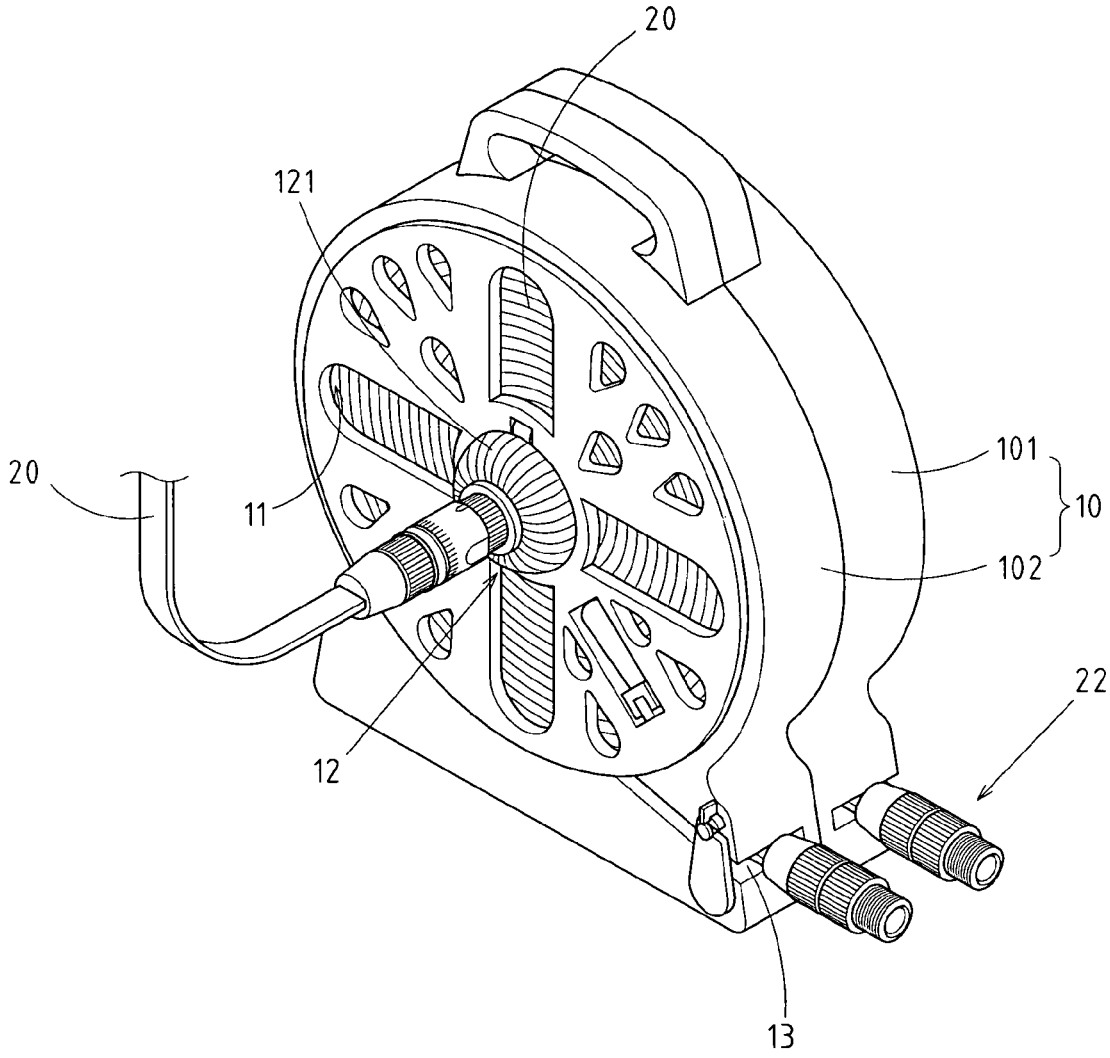
FIG. 8 shows a perspective view of the assembly of the present invention.
Figure 9:
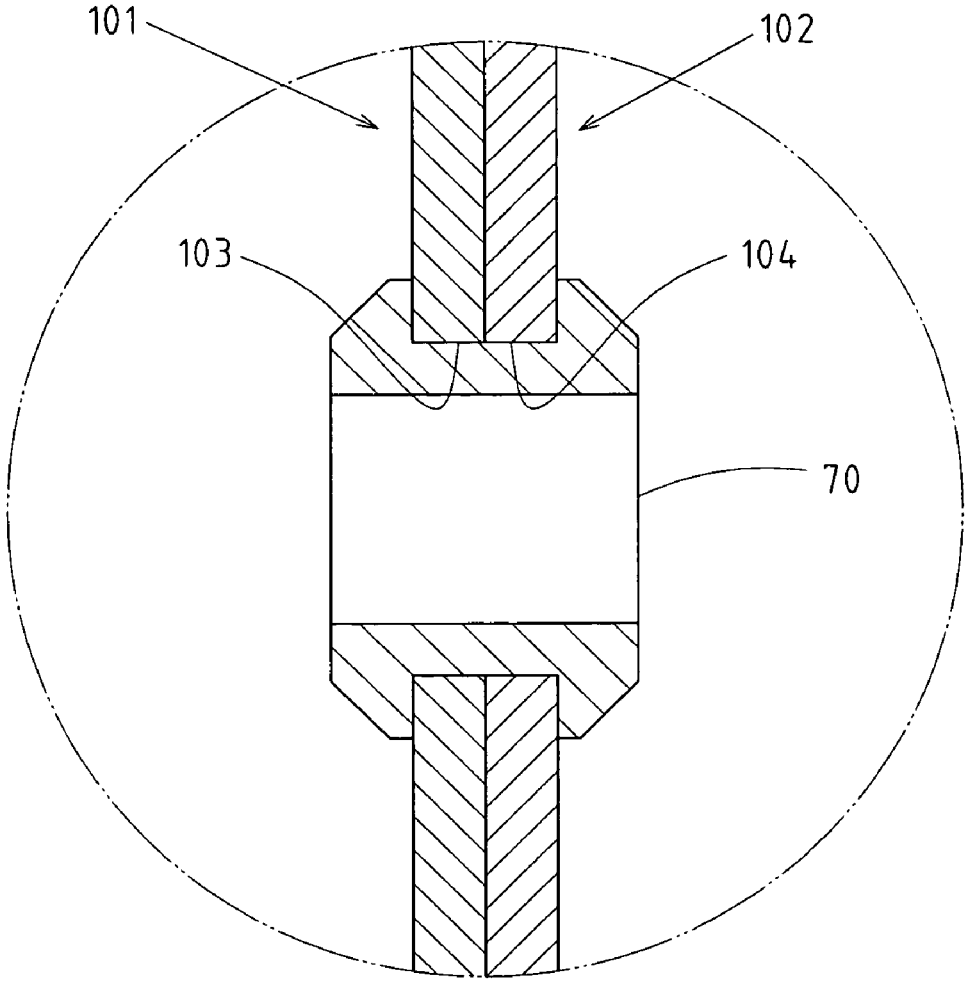
FIG. 9 shows a cross-section view of the assembly of the present invention.

As shown in FIG. 8, the main frame 10 can also be comprised of front and rear frame 101 102. The opposite surfaces of the front and rear frames together form through holes 103 104 (as shown in FIG. 9) to stabilize the front and rear frames 101 102.

What is claimed is:

1. A gardening hose reel apparatus comprising:

a main frame having a generally circular reel receiving area and a generally horizontal base positioned therebelow, said main frame having a through notch formed through a wall of said base;

a reel rotatably mounted in said reel receiving area of said main frame, said reel having a reel notch formed in a wall thereof and extending across a radius of said wall, said reel having an outlet extending outwardly from said wall;

a gardening hose rolled upon said reel, said gardening hose having a water inlet terminal connected to said outlet of said reel, said gardening hose having a water outlet terminal extending outwardly of said through notch, said reel notch exposing said gardening hose through said wall;

a rotary connector means connected to said outlet of said reel, said rotary connector means having a primary connector extending outwardly therefrom;

a water hose having a secondary connector at one end thereof and a water inlet terminal at an opposite end thereof, said secondary connector removably affixed to said primary connector, said rotary connector means for allowing said gardening hose to be payed out from said reel without rotating said water hose; and a support frame having a horizontal frame portion receiving said base of said main frame therein, said support frame having a vertical frame portion having a hinge affixed thereto suitable for allowing said support frame to be hingedly affixed to an external surface.

2. The apparatus of claim 1, said primary connector and said secondary connector forming a casing with a pivot hole so as to allow relative rotation therebetween, said primary connector connected to a water inlet terminal of said gardening hose.

3. The apparatus of claim 1, said support frame being pivotally mounted so as to pivot in accordance with a pulling direction applied upon said water outlet terminal of said gardening hose.

4. The apparatus of claim 1, said main frame comprising a front frame and a rear frame, said through notch defined by facing notches on said front and rear frames.

* * * * *